US010675199B2

(12) United States Patent
Chang et al.

(10) Patent No.: US 10,675,199 B2
(45) Date of Patent: Jun. 9, 2020

(54) PATIENT SUPPORT STRUCTURE, PRESSURE RELIEF MODULE AND NON-POWERED PRESSURE REGULATION METHOD

(71) Applicant: APEX MEDICAL CORP., New Taipei (TW)

(72) Inventors: Ming-Lung Chang, New Taipei (TW); Shih-Chung Liu, New Taipei (TW); Yi-Ling Liu, New Taipei (TW)

(73) Assignee: APEX MEDICAL CORP., New Taipei (TW)

( * ) Notice: Subject to any disclaimer, the term of this patent is extended or adjusted under 35 U.S.C. 154(b) by 297 days.

(21) Appl. No.: 15/790,363

(22) Filed: Oct. 23, 2017

(65) Prior Publication Data

US 2018/0133079 A1 May 17, 2018

(30) Foreign Application Priority Data

Nov. 11, 2016 (TW) ..... 105136960 A

(51) Int. Cl.

| | |
|---|---|
| ***A61G 7/057*** | (2006.01) |
| ***A47C 27/08*** | (2006.01) |
| ***A47C 27/14*** | (2006.01) |

(52) U.S. Cl.

CPC ..... *A61G 7/05776* (2013.01); *A61G 7/05715* (2013.01); *A61G 7/05723* (2013.01); *A61G 7/05769* (2013.01); *A61G 7/05792* (2016.11); *A47C 27/088* (2013.01); *A47C 27/144* (2013.01); *A47C 27/146* (2013.01)

(58) Field of Classification Search

CPC ..... A61G 7/05776; A61G 7/05792; A61G 7/05715; A61G 7/05723; A61G 7/05769; A61G 2203/70; A47C 27/088; A47C 27/144; A47C 27/146

USPC ..... 5/713

See application file for complete search history.

(56) References Cited

U.S. PATENT DOCUMENTS

| | | | | | |
|---|---|---|---|---|---|
| 3,047,282 | A * | 7/1962 | Hardy | B26D 3/006 | 267/145 |
| 3,209,380 | A * | 10/1965 | Watsky | A47C 27/15 | 5/724 |
| 3,222,697 | A * | 12/1965 | Scheermesser | A47C 27/144 | 428/160 |
| 3,681,797 | A * | 8/1972 | Messner | A47C 21/046 | 297/180.13 |
| 3,707,009 | A * | 12/1972 | Wagner | A47C 27/144 | 428/116 |

(Continued)

*Primary Examiner* — Nicholas F Polito
*Assistant Examiner* — Luke Hall
(74) *Attorney, Agent, or Firm* — Muncy, Geissler, Olds & Lowe, P.C.

(57) ABSTRACT

A patient support structure includes a first supporting part, a second supporting part and a third supporting part. The first supporting part includes a first resilient member; the second supporting part includes a second resilient member; and the third supporting part is between the first supporting part and the second supporting part. The first supporting part, the second supporting part and the third supporting part together define a supporting surface extending along a longitudinal axis, and the second resilient member includes a first supporting area and a second supporting area different in supporting strength.

7 Claims, 16 Drawing Sheets

(56) References Cited

U.S. PATENT DOCUMENTS

| | | | | | |
|---|---|---|---|---|---|
| 4,750,720 | A * | 6/1988 | Wolf | F16F 1/377 | 267/140.11 |
| 4,982,466 | A * | 1/1991 | Higgins | A47C 27/082 | 5/713 |
| 5,893,184 | A * | 4/1999 | Murphy | A47C 7/024 | 297/229 |
| 6,237,173 | B1 * | 5/2001 | Schlichter | A47C 27/144 | 5/722 |
| 6,311,351 | B1 * | 11/2001 | Murphy | A47C 27/144 | 5/657 |
| 7,036,172 | B2 * | 5/2006 | Torbet | A47C 27/082 | 5/713 |
| 7,090,911 | B2 * | 8/2006 | Lascelles | B32B 3/28 | 428/163 |
| D787,234 | S * | 5/2017 | Szpyt | D6/605 | |
| 2010/0325806 | A1 * | 12/2010 | Letton | A47C 27/056 | 5/691 |
| 2011/0035879 | A1 * | 2/2011 | Grinstead | A47C 27/001 | 5/421 |

* cited by examiner

Example a

Comparative Example b

Comparative Example c

Example a

Comparative Example b

Comparative Example c

Example a

Comparative Example b

Comparative Example c

PATIENT SUPPORT STRUCTURE, PRESSURE RELIEF MODULE AND NON-POWERED PRESSURE REGULATION METHOD

CROSS-REFERENCE TO RELATED APPLICATION

This application claims the priority benefits of Taiwan Patent Application No. 105136960, filed on Nov. 11, 2016. The entirety of the above-mentioned patent application is hereby incorporated by reference herein and made a part of this specification.

BACKGROUND

1. Field of the Disclosure

The present disclosure relates to a patient support structure and more particularly to a patient support structure providing different levels of supporting strength. The present disclosure also provides a pressure relief module and a non-powered pressure regulation method applicable to the patient support structure.

2. Description of Related Arts

For bedridden patients, lying in the same position for an extended period of time will cause the weight of body to place pressure on the same area, such as back or hip area, and lead to pressure ulcers, also known as pressure sores or bedsores. To avoid the above-mentioned situation, it is advisable to change the position of the patient as much as appropriate; in addition, pressure relief devices such as soft cushions and air mattresses are useful for relieving the pressure on the patient's body.

However, for heavier patients, soft cushions sometimes fail to provide sufficient pressure reduction and support, such that these soft cushions become bottoming-out when a heavier patient is lying thereon and therefore unable to serve the intended pressure relief purpose due to the increase of pressure and contact area between the patient and the bottom. While air mattresses may allow adjustment of pneumatic pressure in air cells to provide better support, excessively high pneumatic pressure will increase the hardness of air cells to an undesirable level and cause patient's discomfort; on the other hand, improper pressure release or deflation from air cells will lead to possible bottoming-out problems. Accordingly, conventional pressure relief devices fail to satisfy all patient's need for pressure ulcer prevention, particularly heavier patient's need.

Therefore, it is desirable to provide a patient support structure which is applicable to a wide range of body weight and provides different supporting mechanisms corresponding to different patients.

SUMMARY

It is a primary object of the present disclosure to provide a patient support structure capable of providing different supporting strengths.

Specifically, the patient support structure according to the present disclosure comprises a first supporting part, a second supporting part and a third supporting part. The first supporting part comprises a first resilient member; the second supporting part comprises a second resilient member; and the third supporting part is between the first supporting part and the second supporting part. The first supporting part, the second supporting part and the third supporting part together define a supporting surface extending along a longitudinal axis, and the second resilient member comprises a first supporting area and a second supporting area different in supporting strength.

In one embodiment of the patient support structure according to the present disclosure, the first supporting area has a supporting strength less than that of the second supporting area, and the first supporting area is arranged between the supporting surface and the second supporting area.

In one embodiment of the patient support structure according to the present disclosure, the first supporting area comprises a plurality of alternately arranged opposite through holes individually having a substantially triangular cross section.

In one embodiment of the patient support structure according to the present disclosure, the second resilient member comprises a plurality of foams arranged independently and extending in parallel to the longitudinal axis of the supporting surface.

In one embodiment, the patient support structure is a hybrid pressure relief device, wherein the third supporting part comprises a pneumatic pressure relief module comprising an air cell and a third resilient member disposed in the air cell.

In one embodiment of the patient support structure according to the present disclosure, the third resilient member comprises a plurality of blind holes perpendicular to the supporting surface.

In one embodiment of the patient support structure according to the present disclosure, the third resilient member comprises a first foam and a second foam, wherein the air cell secures relative positions of the first foam and the second foam by covering the third resilient member.

In one embodiment of the patient support structure according to the present disclosure, under an external pressure corresponding to a body weight less than 100 kg body weight, the supporting surface has greater than 99% of pressure relief index being less than 32 mmHg; under an external pressure corresponding to a body weight between 100 kg and 200 kg body weight, the supporting surface has greater than 99% of pressure relief index being less than 32 mmHg; or under an external pressure corresponding to a body weight greater than or equal to 180 kg body weight, the supporting surface has greater than 85% of pressure relief index being less than 32 mmHg.

In one embodiment of the patient support structure according to the present disclosure, the supporting surface, with the presence of a 70 kg to 200 kg body weight thereon, has a peak surface pressure of less than 37 mmHg at the second supporting part, and the supporting surface, with the presence of a 70 kg to 200 kg body weight thereon, has a peak surface pressure of less than 40 mmHg at the first supporting part.

Another object of the present disclosure is to provide a pressure relief module.

Specifically, the pressure relief module according to the present disclosure comprises an air cell and an air pressure regulation element disposed in the air cell, wherein the air pressure regulation element comprises a first pressure relief section and a second pressure relief section with different pressure relief capacity.

In one embodiment of the pressure relief module according to the present disclosure, the first pressure relief section and the second pressure relief section individually comprise a first resilient member and a second resilient member, and the air cell secures relative positions of the first resilient member and the second resilient member by covering the air pressure regulation element.

In one embodiment of the pressure relief module according to the present disclosure, the air pressure regulation element comprises a resilient member with a plurality of blind holes.

In one embodiment, the pressure relief module according to the present disclosure further comprises a check valve and a pressure regulating valve both communicated with the air cell.

In one embodiment of the pressure relief module according to the present disclosure, the first pressure relief section and the second pressure relief section have substantially the same cross section, and the first pressure relief section is 1.5 to 2.5 times thicker than the second pressure relief section.

Still another object of the present disclosure is to provide a non-powered pressure regulation method.

Specifically, the non-powered pressure regulation method according to the present disclosure comprises: providing a pressure regulation device comprising at least one air cell, a resilient member disposed in the air cell, and a check valve and a pressure regulating valve both communicated with the air cell, the resilient member having a punched section and an unpunched section, the pressure regulating valve having a pressure threshold; and applying an external pressure to the pressure regulation device to deform the pressure regulation device such that the punched section and the unpunched section provide pressure support of different strengths; wherein if the external pressure causes a pneumatic pressure at the pressure regulation device of greater than the pressure threshold, the pressure regulating valve discharges air to adjust the pneumatic pressure.

In one embodiment, the non-powered pressure regulation method according to the present disclosure further comprises: when the external pressure is reduced or removed, the pressure regulation device recovering its original shape to introduce air from the check valve.

In one embodiment of the non-powered pressure regulation method according to the present disclosure, if the external pressure is originated from a less than 100 kg body weight, the pressure regulation device has greater than 99% of pressure relief index being less than 32 mmHg; if the external pressure is originated from a 100 kg to 200 kg body weight, the pressure regulation device has greater than 99% of pressure relief index being less than 32 mmHg; or if the external pressure is originated from a greater than or equal to 180 kg body weight, the pressure regulation device has greater than 85% of pressure relief index being less than 32 mmHg.

In particular, the present disclosure further provides the following embodiments:

Embodiment #1

A patient support structure, comprising:

a first supporting part comprising a first resilient member;

a second supporting part comprising a second resilient member; and a third supporting part between the first supporting part and the second supporting part;

wherein the first supporting part, the second supporting part and the third supporting part together define a supporting surface extending along a longitudinal axis, and wherein the second resilient member comprises a first supporting area and a second supporting area different in supporting strength.

Embodiment #2

The patient support structure of Embodiment #1, wherein the first supporting area has a supporting strength less than that of the second supporting area, and wherein the first supporting area is arranged between the supporting surface and the second supporting area.

Embodiment #3

The patient support structure of Embodiment #2, wherein the first supporting area and the second supporting area individually comprise a plurality of first weakening structures and second weakening structures arranged at the same interval.

Embodiment #4

The patient support structure of Embodiment #2, wherein the first supporting area and the second supporting area individually comprise a plurality of through holes extending in the same direction, and wherein the through holes of the first supporting area define a volume greater than that of the through holes of the second supporting area.

Embodiment #5

The patient support structure of Embodiment #1, wherein the first supporting area comprises a plurality of alternately arranged opposite through holes individually having a substantially triangular cross section.

Embodiment #6

The patient support structure of Embodiment #1, wherein the second resilient member comprises a plurality of foams arranged independently and extending in parallel to the longitudinal axis of the supporting surface.

Embodiment #7

The patient support structure of Embodiment #6, wherein each foam comprises a plurality of transverse large through holes in the first supporting area and a plurality of transverse small through holes in the second supporting area.

Embodiment #8

The patient support structure of Embodiment #1, wherein the first supporting part, the second supporting part and the third supporting part are respectively corresponded to patient's head, legs and torso.

Embodiment #9

The patient support structure of Embodiment #8, further comprising fall prevention structures respectively arranged at two sides of the supporting surface.

Embodiment #10

The patient support structure of Embodiment #9, wherein each fall prevention structure has first notches formed at one side adjacent to the supporting surface and second notches formed at one side distal from the supporting surface, the first notches and the second notches being configured to reduce deforming stress.

Embodiment #11

The patient support structure of Embodiment #8, further comprising a bottom cushion disposed at one side of the first supporting part, the second supporting part and the third supporting part opposite to the supporting surface.

Embodiment #12

The patient support structure of Embodiment #11, wherein the bottom cushion has a horizontal section with a constant thickness and an inclined section with a gradually decreased thickness, and the inclined section and the horizontal section together define an included angle from 1 to 10 degrees.

Embodiment #13

The patient support structure of Embodiment #1, which is a hybrid pressure relief device, wherein the third supporting part comprises a pneumatic pressure relief module comprising an air cell and a third resilient member disposed in the air cell.

Embodiment #14

The patient support structure of Embodiment #13, wherein the pneumatic pressure relief module further comprises a check valve and a pressure regulating valve both communicated with the air cell.

Embodiment #15

The patient support structure of Embodiment #13, wherein the third resilient member comprises a plurality of blind holes perpendicular to the supporting surface.

Embodiment #16

The patient support structure of Embodiment #13, wherein the third resilient member comprises a first supporting area and a second supporting area different in supporting strength.

Embodiment #17

The patient support structure of Embodiment #13, wherein the third resilient member comprises a punched section and an unpunched section.

Embodiment #18

The patient support structure of Embodiment #13, wherein the third resilient member comprises a first foam and a second foam, and wherein the air cell secures relative positions of the first foam and the second foam by covering the third resilient member.

Embodiment #19

The patient support structure of Embodiment #18, wherein the first foam comprises a plurality of punched holes perpendicular to the supporting surface.

Embodiment #20

The patient support structure of Embodiment #18, wherein the first foam and the second foam have substantially the same shape, and the first foam is 1.5 to 2.5 times thicker than the second foam.

Embodiment #21

The patient support structure of Embodiment #13, wherein the third supporting part comprises a plurality of pneumatic pressure relief modules communicated with each other and transversely arranged side by side between the first supporting part and the second supporting part.

Embodiment #22

The patient support structure of Embodiment #1, wherein under an external pressure corresponding to a body weight less than 100 kg, the supporting surface has greater than 99% of pressure relief index being less than 32 mmHg.

Embodiment #23

The patient support structure of Embodiment #1, wherein under an external pressure corresponding to a body weight between 100 kg and 200 kg, the supporting surface has greater than 99% of pressure relief index being less than 32 mmHg.

Embodiment #24

The patient support structure of Embodiment #1, wherein under an external pressure of greater than or equal to 180 kg body weight, the supporting surface has greater than 85% of pressure relief index being less than 32 mmHg.

Embodiment #25

The patient support structure of Embodiment #1, wherein with the presence of a 70 kg to 200 kg body weight thereon, the supporting surface has a peak surface pressure of less than 37 mmHg at the second supporting part.

Embodiment #26

The patient support structure of Embodiment #1, wherein with the presence of a 70 kg to 200 kg body weight thereon, the supporting surface has a peak surface pressure of less than 40 mmHg at the first supporting part.

Embodiment #27

A pressure relief module, comprising an air cell and an air pressure regulation element disposed in the air cell, wherein the air pressure regulation element comprises a first pressure relief section and a second pressure relief section with different pressure relief capacity.

Embodiment #28

The pressure relief module of Embodiment #27, wherein the first pressure relief section comprises a plurality of punched holes arranged at the same interval.

Embodiment #29

The pressure relief module of Embodiment #27, wherein the first pressure relief section and the second pressure relief section individually comprise a first resilient member and a second resilient member, and the air cell secures relative positions of the first resilient member and the second resilient member by covering the air pressure regulation element.

Embodiment #30

The pressure relief module of Embodiment #27, wherein the air pressure regulation element comprises a resilient member with a plurality of blind holes.

Embodiment #31

The pressure relief module of Embodiment #27, wherein the air pressure regulation element comprises a punched section and an unpunched section.

Embodiment #32

The pressure relief module of Embodiment #27, further comprising a check valve and a pressure regulating valve both communicated with the air cell.

Embodiment #33

The pressure relief module of Embodiment #27, wherein the first pressure relief section and the second pressure relief section have substantially the same cross section, and the first pressure relief section is 1.5 to 2.5 times thicker than the second pressure relief section.

Embodiment #34

The pressure relief module of Embodiment #27, comprising a plurality of air cells communicated with each other and a plurality of air pressure regulation elements respectively disposed in the air cells.

Embodiment #35

A non-powered pressure regulation method, comprising: providing a pressure regulation device comprising at least one air cell, a resilient member disposed in the air cell, and a check valve and a pressure regulating valve both communicated with the air cell; and applying an external pressure to the pressure regulation device to deform the pressure regulation device such that the resilient member provides pressure support of different strengths;

wherein if the external pressure causes a pneumatic pressure at the pressure regulation device of greater than a threshold, the pressure regulating valve discharges air to adjust the pneumatic pressure.

Embodiment #36

The non-powered pressure regulation method of Embodiment #35, further comprising: when the external pressure is reduced or removed, the pressure regulation device recovering its original shape to introduce air from the check valve.

Embodiment #37

The non-powered pressure regulation method of Embodiment #35, wherein the punched section defines a volume 1.5 to 2.5 times greater than that of the unpunched section.

Embodiment #38

The non-powered pressure regulation method of Embodiment #35, if the external pressure is originated from a less than 100 kg body weight, the pressure regulation device has greater than 99% of pressure relief index being less than 32 mmHg.

Embodiment #39

The non-powered pressure regulation method of Embodiment #38, if the external pressure is originated from a 100 kg to 200 kg body weight, the pressure regulation device has greater than 99% of pressure relief index being less than 32 mmHg.

Embodiment #40

The non-powered pressure regulation method of Embodiment #39, if the external pressure is originated from a greater than or equal to 180 kg body weight, the pressure regulation device has greater than 85% of pressure relief index being less than 32 mmHg.

DETAILED DESCRIPTION OF EMBODIMENTS

Since various aspects and embodiments are merely exemplary and not limiting, after reading this specification, skilled artisans appreciate that other aspects and embodiments are possible without departing from the scope of the disclosure. Other features and benefits of any one or more of the embodiments will be apparent from the following detailed description and the claims.

As used herein, the terms "comprises," "comprising," "includes," "including," "has," "having" and any other variation thereof are intended to cover a non-exclusive inclusion. For example, a component or structure that comprises a list of elements is not necessarily limited to only those elements but may include other elements not expressly listed or inherent to such component or structure.

Figure 1:
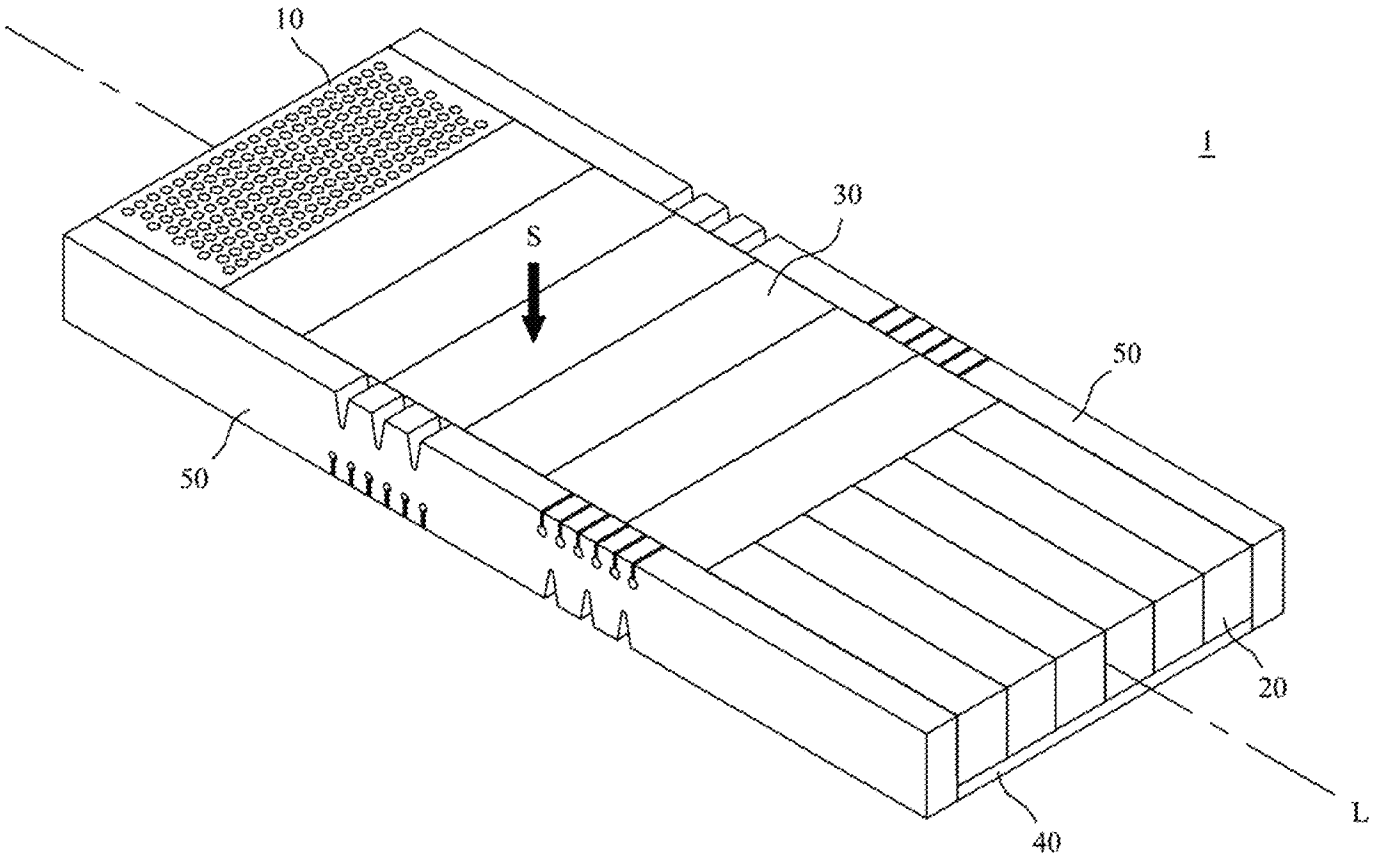
FIG. 1 illustrates an example of the patient support structure according to the present disclosure.
Figure 2:
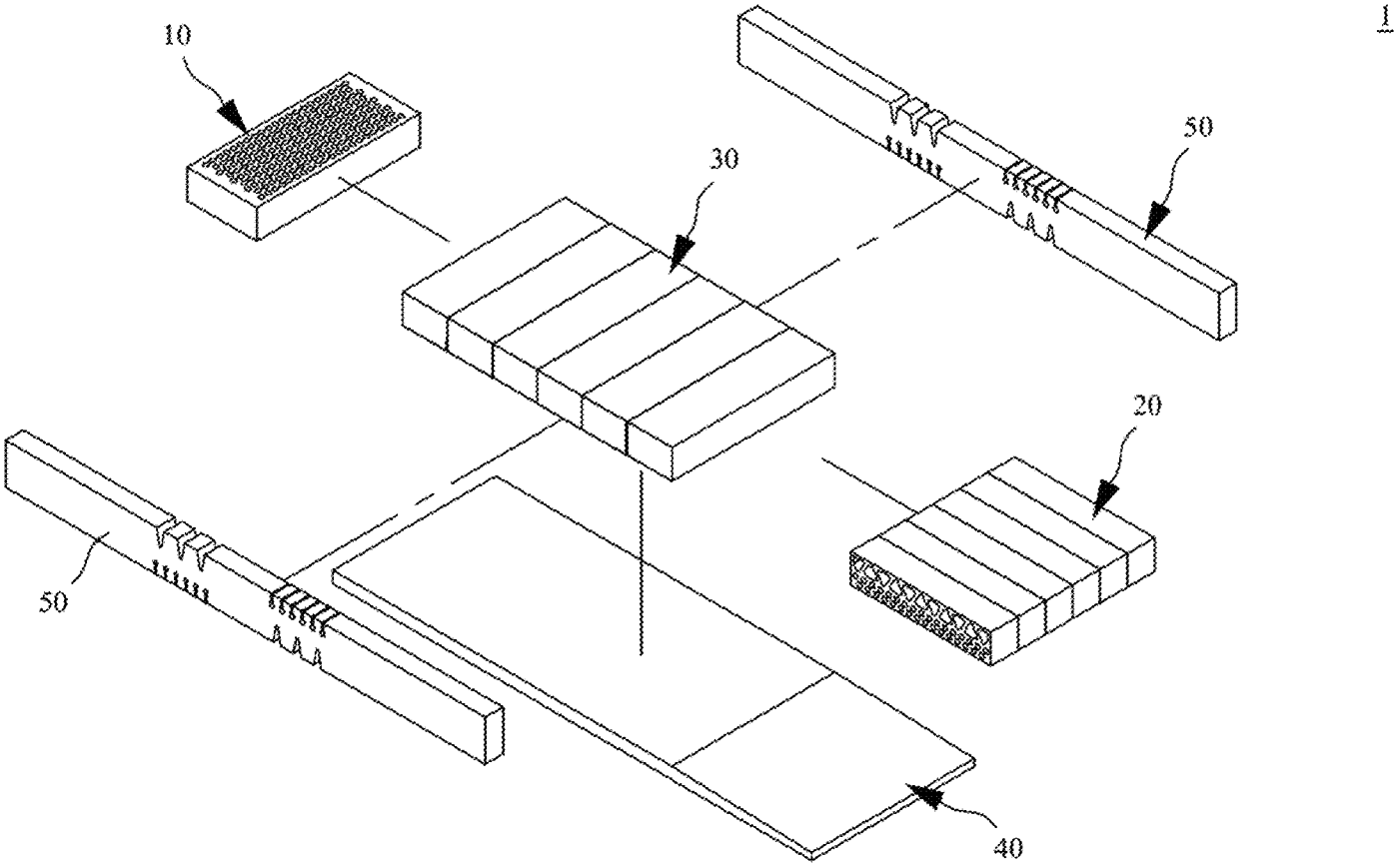
FIG. 2 illustrates the exploded view of the patient support structure according to the present disclosure.

Refer to FIG. 1 and FIG. 2. The patient support structure 1 according to the present disclosure may be configured as an assembly of multiple components to provide different levels of support and cushioning for different parts of patients lying thereon and reduce the contact pressure acting on patients so as to prompt the lying comfort.

As illustrated in FIG. 1 and FIG. 2, the patient support structure 1 according to the present disclosure comprises a first supporting part 10, a second supporting part 20 and a third supporting part 30, wherein the third supporting part 30 is between the first supporting part 10 and the second supporting part 20. The patient support structure 1 according to the present disclosure, through the combination of the first supporting part 10, the second supporting part 20 and the third supporting part 30, may have an overall length of greater than or equal to patient's height and an overall width of greater than or equal to patient's width. In this embodiment, the patient support structure 1 according to the present disclosure is extended along a longitudinal axis L and has a symmetric structure relative to the longitudinal axis L, wherein the overall length of the patient support structure 1 is the total length of extension along the longitudinal axis L, and the overall width of the patient support structure 1 is the total width of transverse extension perpendicular to the longitudinal axis L.

The first supporting part 10, the second supporting part 20 and the third supporting part 30 together define a supporting surface S, on which a patient may lie, extending along the longitudinal axis L, and the supporting surface S has edges with length as defined by the overall length and overall width of the patient support structure 1. In one embodiment, the first supporting part 10, the second supporting part 20 and the third supporting part 30 are respectively corresponded to patient's head, legs and torso so as to provide different supports to different parts of patient's body.

Figure 3:
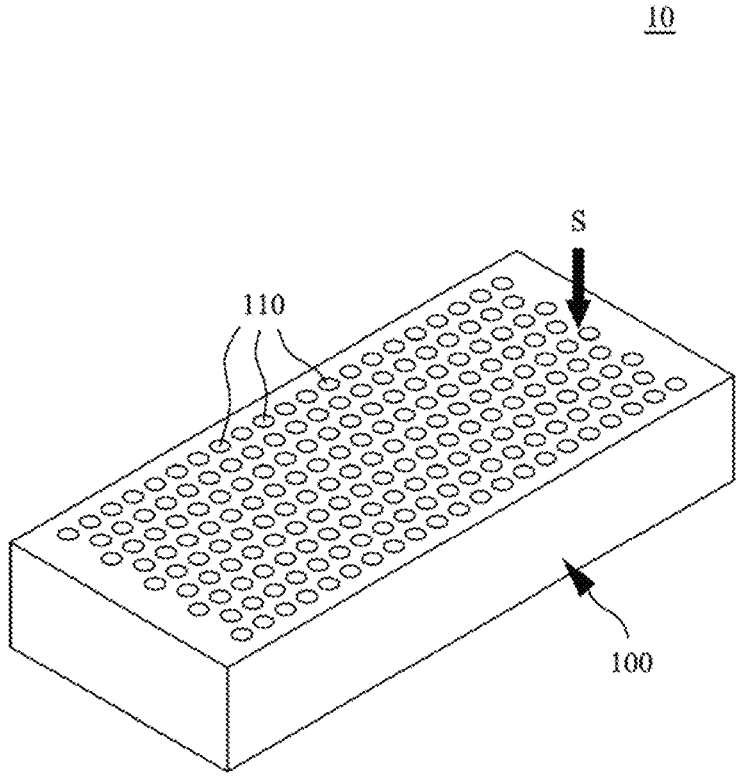
FIG. 3 illustrates a first supporting part of the patient support structure according to the present disclosure.

Refer to FIG. 1 to FIG. 3. As shown in FIG. 1 to FIG. 3, the first supporting part 10 comprises a first resilient member 100 having a plurality of through holes 110 penetrating from the supporting surface S through opposite sides of the first resilient member 100. In this embodiment, the first resilient member 100 may be a foamed material but not limited thereto. The first supporting part 10 is configured to correspondingly support patient's head and has a structure weakened by a plurality of through holes 110 to reduce the contact pressure between patient's head and the first supporting part 10; preferably, with the presence of the plurality of through holes 110, the contact pressure between patient's head and the first supporting part 10 is maintained below 32 mmHg. A pressure of 32 mmHg represents the blood pressure at the arteriolar end of a capillary; therefore, if the contact pressure is greater than 32 mmHg for an extended period of time, the capillary may be collapsed to cause poor blood circulation or even broken.

In one embodiment, the plurality of through holes 110 are independently extended in the same direction and substantially perpendicular to the supporting surface S. The plurality of through holes 110 may have the same aperture and length and be evenly distributed, but are not limited thereto. For example, the plurality of through holes 110 may be communicated with each other or have different apertures, lengths or orientations.

Figure 4:
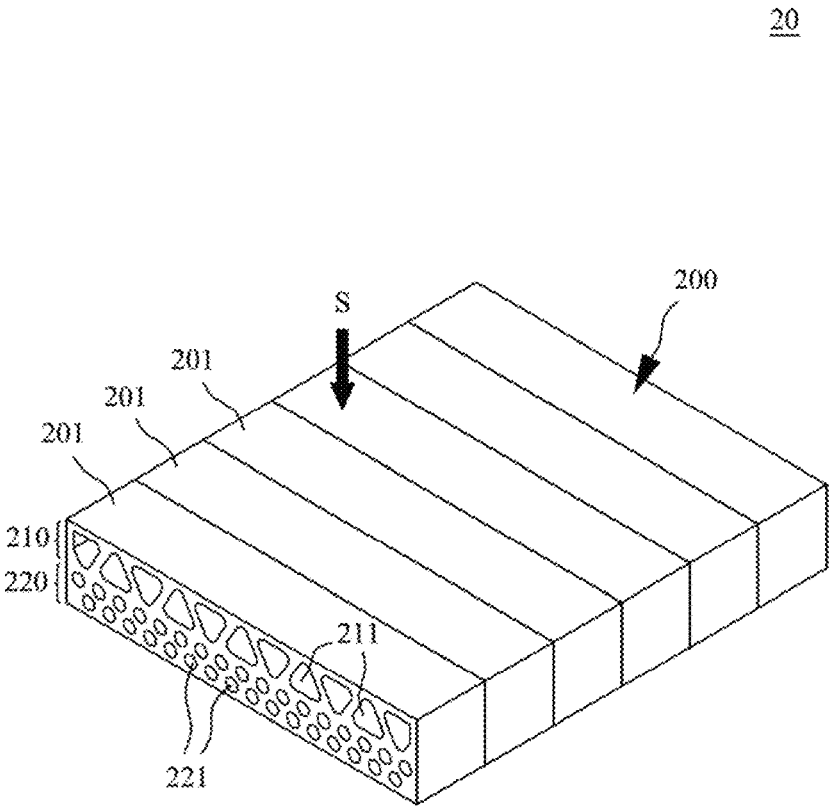
FIG. 4 illustrates a second supporting part of the patient support structure according to the present disclosure.

Refer to FIG. 1, FIG. 2 and FIG. 4. As shown in FIG. 1, FIG. 2 and FIG. 4, the second supporting part 20 comprises a second resilient member 200 which comprises a first supporting area 210 and a second supporting area 220 different in supporting strength. The first supporting area 210 has a supporting strength less than that of the second supporting area 220, and the first supporting area 210 is arranged between the supporting surface S and the second supporting area 220; in other words, the second resilient member 200 has a low supporting strength area adjacent to the supporting surface S and a high supporting strength area distal from the supporting surface S.

The second supporting part 20 is configured to support patient's legs. The first supporting area 210 and the second supporting area 220 of the second supporting part 20 respectively comprise a plurality of first weakening structures 211 and second weakening structures 221 arranged at the same interval. In one embodiment, the first supporting area 210 and the second supporting area 220 both comprise a plurality of through holes extending in the same direction; the first supporting area 210 uses the through holes as the plurality of first weakening structures 211 to determine its supporting strength, and the second supporting area 220 uses the through holes as the plurality of second weakening structures 221 to determine its supporting strength. In this embodiment, the first supporting area 210 and the second supporting area 220 have the same volume, wherein the plurality of through holes of the first supporting area 210 collectively define a total volume greater than that of the plurality of through holes of the second supporting area 220, such that the first supporting area 210 has a supporting strength less than that of the second supporting area 220. As used herein, the total volume refers to the total void or hollow space in the supporting area as defined by the plurality of through holes.

Figure 5A:
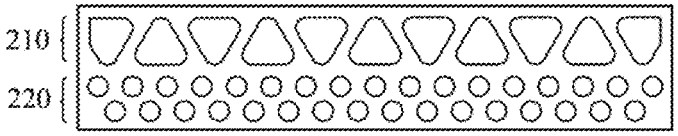
FIG. 5*a* to FIG. 5*d* illustrate various second supporting parts of the patient support structure according to the present disclosure.

The plurality of through holes of the first supporting area 210 may have different arrangements. Refer to FIGS. 5*a* to 5*d*. As shown in FIG. 4 and FIG. 5*a*, in a preferred embodiment, the first supporting area 210 comprises a plurality of alternately arranged opposite (e.g., upside-down or reverse) through holes individually having a substantially triangular cross section, while the second supporting area 220 comprises a plurality of round through holes arranged orderly. That is, in this embodiment, the through holes of the first supporting area 210 are configured as a plurality of substantially triangular prism-like holes alternately arranged opposite to each other, but the present disclosure is not limited thereto.

Figure 5B:
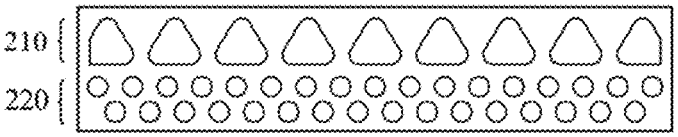
Figure 5C:
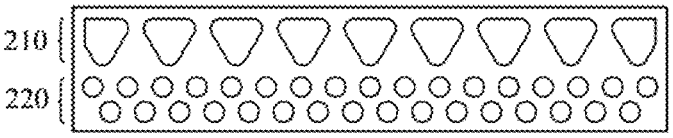
Figure 5D:
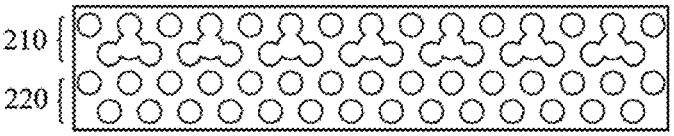

For example, in FIG. 5*b*, the plurality of through holes of the first supporting area 210 are configured as a plurality of side-by-side through holes with a substantially triangular cross section; alternatively, in FIG. 5*c*, the plurality of through holes of the first supporting area 210 are configured as a plurality of side-by-side through holes with a substantially reverse triangular cross section; alternatively, in FIG. 5*d*, the plurality of through holes of the first supporting area 210 are configured as a plurality of through holes with a substantially round cross section communicated with each other by intermediate through holes also with a substantially round cross section. Whatever configuration is used by the second supporting part 20, the first supporting area 210 always has a supporting strength less than that of the second supporting area 220.

As illustrated in FIG. 1, FIG. 2 and FIG. 4, in a preferred embodiment, the second resilient member 200 comprises a plurality of foams 201 arranged independently and extending in parallel to the longitudinal axis L of the supporting surface S. The amount of foams 201 may be adjusted according to patient's width. Each foam 201 comprises a plurality of transverse large through holes in the first supporting area 210 and a plurality of transverse small through holes in the second supporting area 220; the first supporting area 210 uses the transverse large through holes as a plurality of first weakening structures 211, and the second supporting area 220 uses the transverse small through holes as a plurality of second weakening structures 221. In this embodiment, the plurality of transverse large through holes collectively define a total volume greater than that of the plurality of transverse small through holes, such that the first supporting area 210 has a supporting strength less than that of the second supporting area 220.

By the different supporting strengths of the first supporting area 210 and the second supporting area 220, the second supporting part 20 is suitable for patients of different body weights. For example, for a patient with a moderate body weight (e.g., less than 100 kg), the first supporting area 210 may provide sufficient support to patient's legs and maintain the contact pressure below a certain level; for a heavier patient (e.g., greater than 100 kg), even if the first supporting area 210 is collapsed due to insufficient supporting strength, the second supporting area 220 with a greater supporting strength may still provide sufficient support to patient's legs, and the weakening structures configured therein may prevent excessively high contact pressure and discomfort of patient's legs. In addition, when patient's legs are in contact with the second resilient member 200, each leg will be in contact with a single independent foam 201 or two or more foams 201 adjacent to the point of contact with the leg, such that the interference of contact pressure on different legs may be inhibited. Undoubtedly, the second resilient member 200 may also be integrally formed as one piece to meet different needs.

Figure 6A:
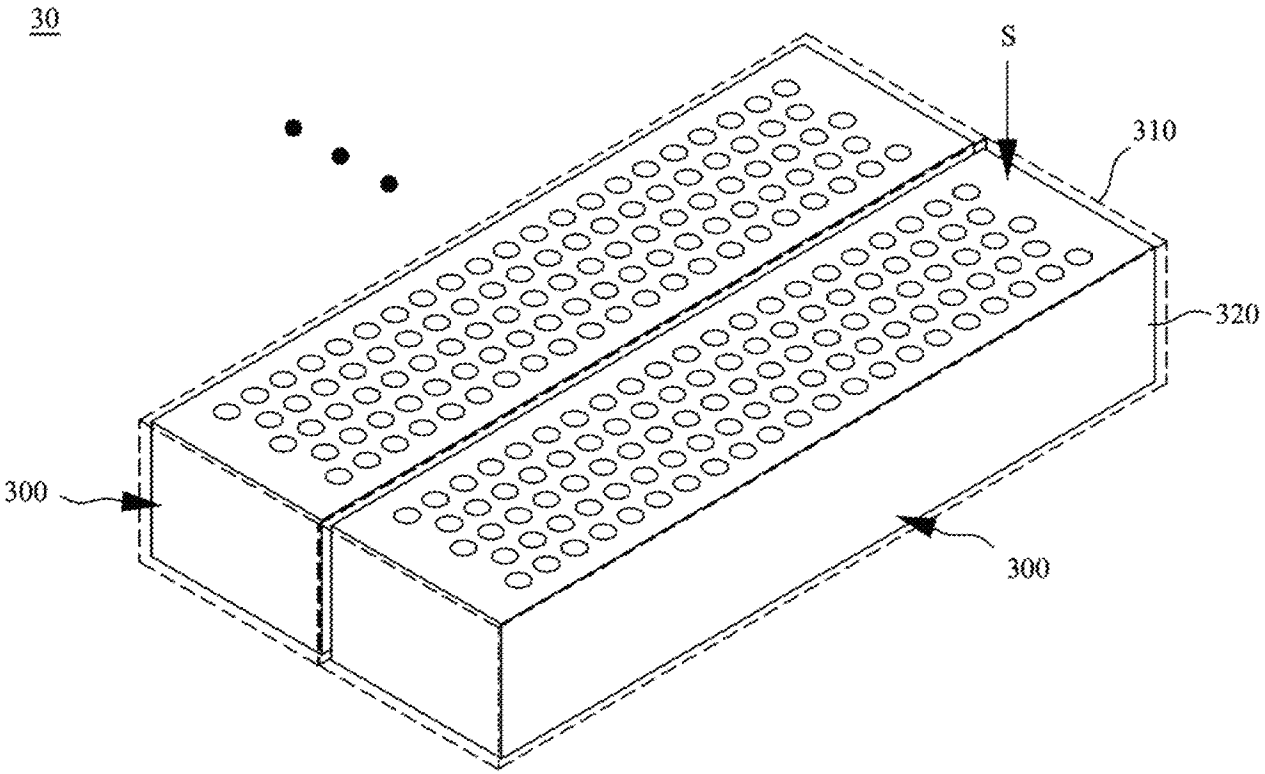
FIG. 6*a* illustrates a third supporting part of the patient support structure according to the present disclosure.
Figure 6B:
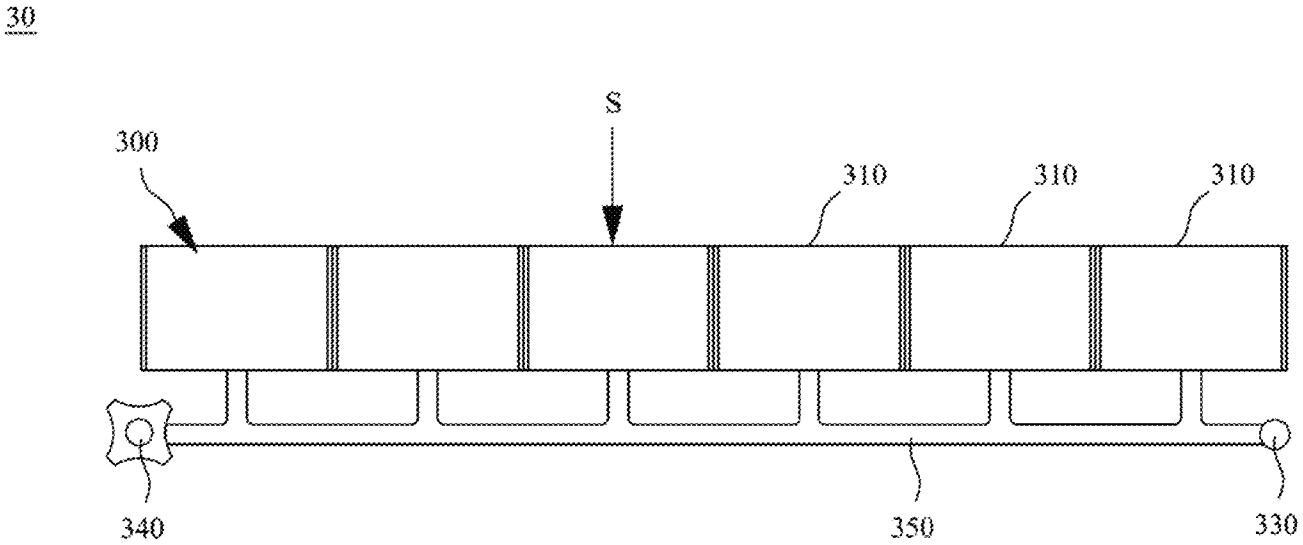
FIG. 6*b* illustrates the pipe configuration of the third supporting part of the patient support structure according to the present disclosure.

Refer to FIGS. 1, 2 and 6*a* to 6*d*. As illustrated in FIGS. 1, 2 and 6*a*, in a preferred embodiment, the patient support structure 1 is configured as a hybrid pressure relief device, wherein the third supporting part 30 comprises at least one pressure relief module 300, which may be a pneumatic pressure relief module that releases internal pressure by gas (e.g., air) discharge or deflation. The pressure relief module 300 comprises an air cell 310 (designated by broken lines in FIG. 6*a*) and an air pressure regulation element disposed in the air cell 310; the air pressure regulation element is secured and covered by the air cell 310 and prevented from moving. As shown in FIG. 6*b*, the pressure relief module 300 further comprises a check valve 330 and a pressure regulating valve 340 both communicated with the air cell 310 via an air pipe 350, wherein the check valve 330 enables introduction of air from outside to the air cell 310 in a unidirectional manner, and the pressure regulating valve 340 controls whether the air in the air cell 310 may be discharged from the air cell 310. The air cell 310 contains air therein, and in an ordinary situation, the pressure in the air cell is the same as the pressure outside the air cell (i.e., the pneumatic pressure is 1 atm). It should be noted that in FIG. 6*b*, the configuration of the check valve 330, pressure regulating valve 340 and air pipe 350 is simply for illustrative purpose, and the actual arrangement of these components may be adjusted according to the design of the patient support structure 1.

Figure 6C:
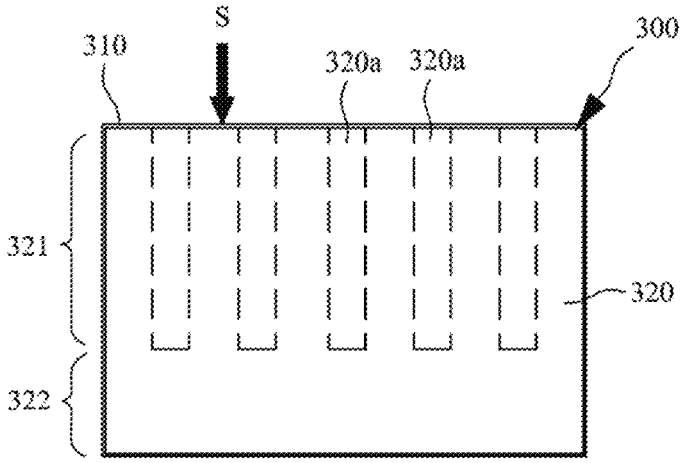
FIG. 6*c* illustrates the side view of the pressure relief module of the patient support structure according to the present disclosure.

As illustrated in FIG. 6*a* and FIG. 6*c*, in one embodiment, the air pressure regulation element comprises a third resilient member 320 which may be an integrally formed one-piece foam structure. The third resilient member 320 comprises a plurality of blind holes 320*a* perpendicular to the supporting surface S and extending vertically from the supporting surface S toward the opposite side of the third resilient member 320 without penetrating through it, such that the third resilient member 320 forms a first supporting area 321 and a second supporting area 322 different in supporting strength. The first supporting area 321 of the third resilient member 320 is the punched section comprising the blind holes 320*a*, and the second supporting area 322 of the third resilient member 320 is the unpunched section not comprising the blind holes 320*a*. Accordingly, the first supporting area 321 and the second supporting area 322 may provide different supporting strengths by the presence or absence of the blind holes 320*a*.

Figure 6D:
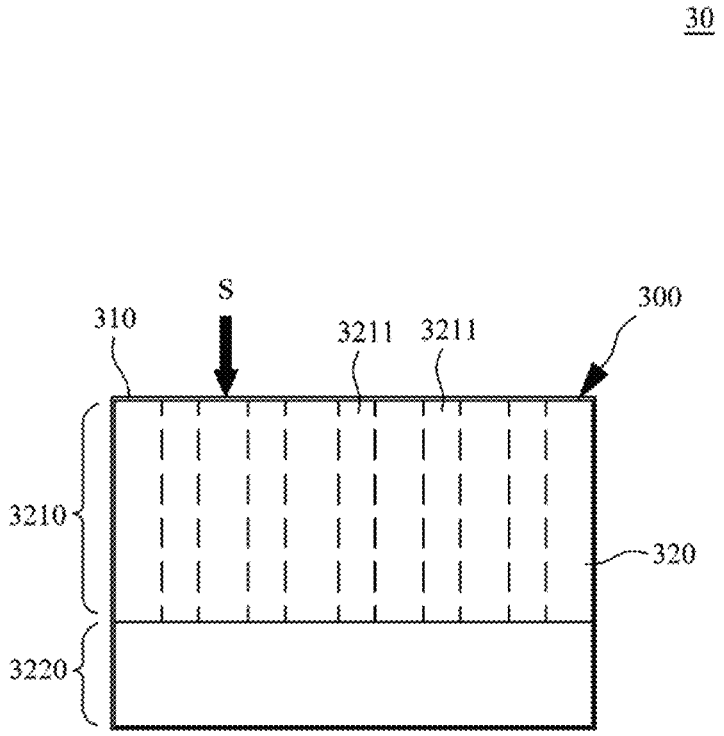
FIG. 6*d* illustrates the side view of another pressure relief module of the patient support structure according to the present disclosure.

In another embodiment, as illustrated in FIG. 6*d*, the third resilient member 320 comprises a first foam 3210 and a second foam 3220, wherein the air cell 310 secures relative positions of the first foam 3210 and the second foam 3220 by covering the third resilient member 320. The first foam 3210 comprises a plurality of punched holes 3211 perpendicular to the supporting surface and extending from the supporting surface S vertically toward the opposite side of the first foam 3210 of the third resilient member 320 and penetrating through it. The first foam 3210 and the second foam 3220 have substantially the same shape and are only different in thickness. In a preferred embodiment of the present disclosure, the first foam 3210 is 1.5 to 2.5 times thicker than the second foam 3220, but the present disclosure is not limited thereto.

In addition, as shown in FIG. 1, FIG. 2 and FIG. 6*a*, in one embodiment, the third supporting part 30 comprises a plurality of pressure relief modules 300 communicated with each other and extended transversely and perpendicular to the longitudinal axis L and arranged side by side between the first supporting part 10 and the second supporting part 20. The amount of pressure relief modules 300 may be adjusted according to patient's width.

From another perspective, in one embodiment, the air pressure regulation element may comprise a first pressure relief section and a second pressure relief section of different pressure relief capacity, wherein the difference of pressure relief capacity may be achieved by the different structural designs of the first pressure relief section and the second pressure relief section. For example, if the air pressure regulation element is an integrally formed resilient member, the resilient member may be punched to form a punched section with a plurality of blind holes and an unpunched section, wherein the punched section may serve as the first pressure relief section, and the unpunched section may serve as the second pressure relief section, and wherein the first pressure relief section and the second pressure relief section have substantially the same cross section. In a preferred embodiment of the present disclosure, the first pressure relief section is 1.5 to 2.5 times thicker than the second pressure relief section. With the presence of the blind holes, the first pressure relief section has a structure more incompact than the second pressure relief section to thereby accommodate more gas, which results in the difference of pressure relief capacity of the two sections.

In one embodiment, the first pressure relief section and the second pressure relief section of the air pressure regulation element individually comprise a first resilient member and a second resilient member, and the air cell secures relative positions of the first resilient member and the second resilient member by covering the air pressure regulation element. The first resilient member may be punched to form a first pressure relief section with a plurality of punched holes which are arranged at the same interval and running through the first resilient member. The presence of the punched holes may also achieve the difference of pressure relief capacity.

Figure 7:
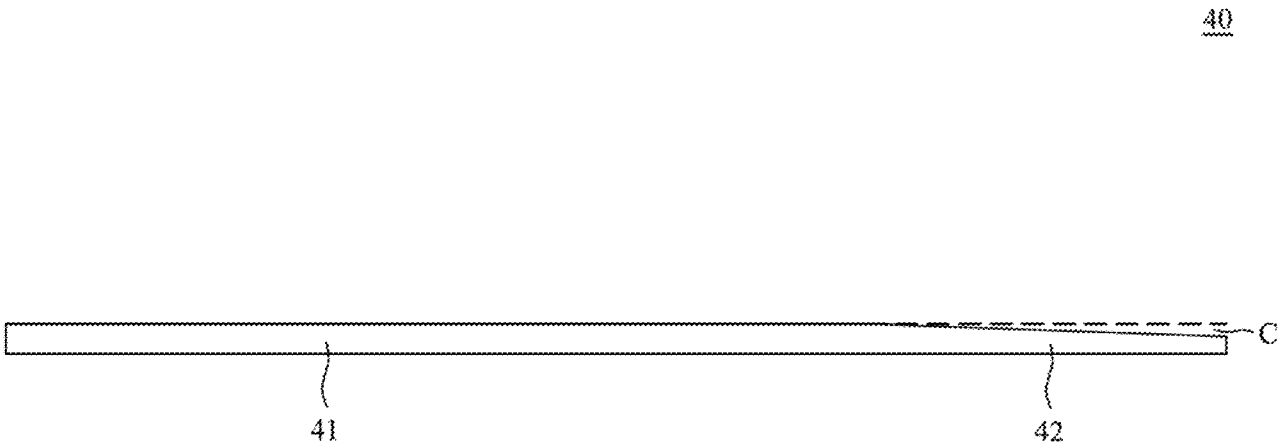
FIG. 7 illustrates a bottom cushion of the patient support structure according to the present disclosure.

Refer to FIG. 1, FIG. 2 and FIG. 7. As shown in FIG. 1, FIG. 2 and FIG. 7, the patient support structure 1 further comprises a bottom cushion 40. The bottom cushion 40 is arranged at one side of the first supporting part 10, the second supporting part 20 and the third supporting part 30 opposite to the supporting surface S and is configured to bear the first supporting part 10, the second supporting part 20 and the third supporting part 30. The bottom cushion 40 may be made of solid foam to serve as the base and provide support for the whole structure. In one embodiment, the bottom cushion 40 has a horizontal section 41 with a constant thickness and an inclined section 42 with a gradually decreased thickness, wherein the horizontal section 41 bears the first supporting part 10 and the third supporting part 30, and the inclined section 42 bears the second supporting part 20. The inclined section 42 and the horizontal section 41 define therebetween an included angle C ranging from 1 to 10 degrees, such that the second supporting part 20 carried on the inclined section 42 is similarly configured at the included angle C relative to the horizontal section 41; in this embodiment, the included angle C is 2 degrees, for example. As such, when a patient is lying on the patient support structure 1, legs rested on the second supporting part 20 may naturally and slightly bent by the included angle C to provide an ergonomic design and enhance lying comfort.

Figure 8:
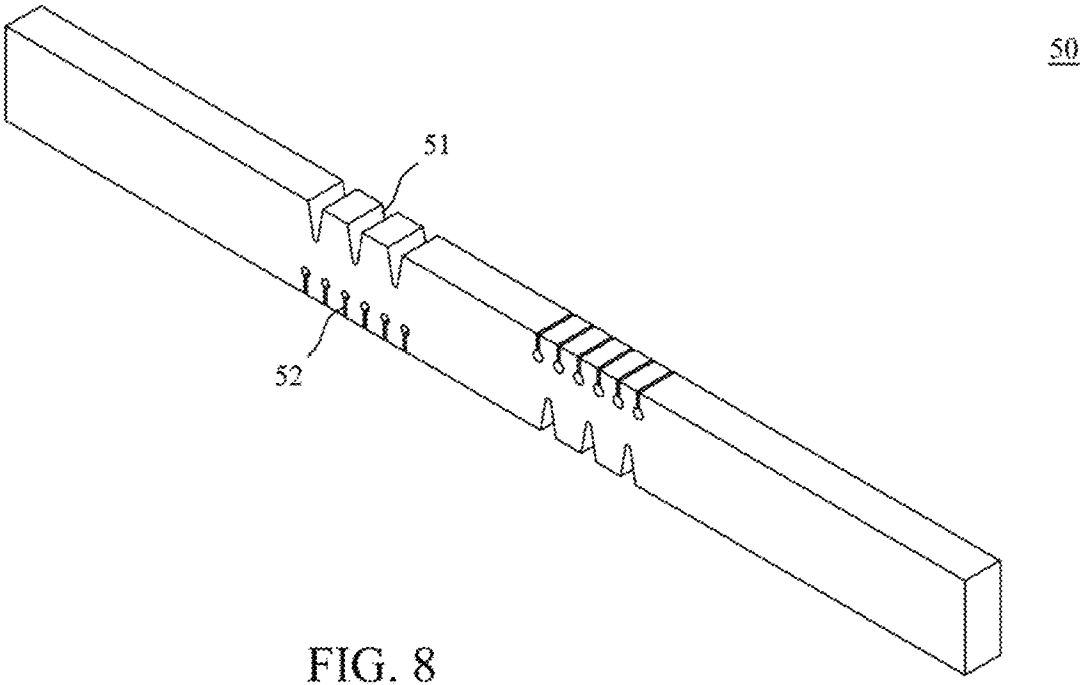
FIG. 8 illustrates a fall prevention structure of the patient support structure according to the present disclosure.

Refer to FIG. 1, FIG. 2 and FIG. 8. As shown in FIG. 1, FIG. 2 and FIG. 8, the patient support structure 1 further comprises fall prevention structures 50 respectively arranged at two sides of the supporting surface S. The fall prevention structures 50 are arranged symmetrically relative to the longitudinal axis L to provide a fall prevention function for a patient lying on the supporting surface S; in addition, the fall prevention structures 50 may be combined with the first supporting part 10, the second supporting part 20, the third supporting part 30 and the bottom cushion 40. The fall prevention structures 50 are formed with first notches 51 on one side adjacent to the supporting surface S and formed with second notches 52 on the other side distal from the supporting surface S; the first notches 51 and the second notches 52 are arranged opposite to each other to reduce the deforming stress of the fall prevention structures 50.

For example, when there is a need to bend the patient support structure 1, such as when the first supporting part 10 and a part of the third supporting part 30 are bent upward to sit the patient up, the first notches 51 and the second notches 52 may serve as the fulcrum during the bending operation. The presence of the first notches 51 and the second notches 52 may reduce the deforming stress generated when the fall prevention structures 50 are bent; in this embodiment, the second notches 52 at the outer side during bending may also increase the stretch of the fall prevention structures 50 so as to facilitate the bending operation of the patient support structure 1. The amount and position of the first notches 51 and the second notches 52 may be varied according to different needs and therefore are not limited to this embodiment.

Figure 9:
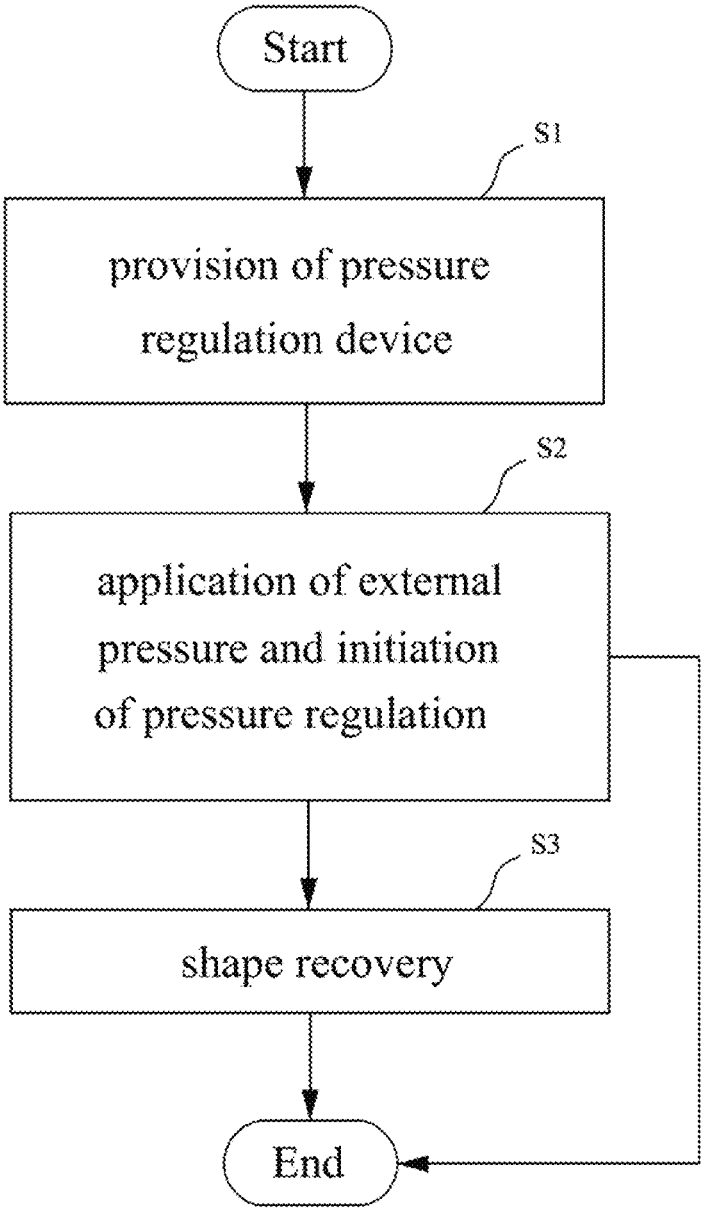
FIG. 9 illustrates the flowchart of a non-powered pressure regulation method according to the present disclosure.

FIG. 9 illustrates the flowchart of a non-powered pressure regulation method according to the present disclosure. As illustrated in FIG. 9, the non-powered pressure regulation method is applicable to the patient support structure 1 and comprises steps S1 and S2, as elaborated below.

Step S1: providing a pressure regulation device comprising at least one air cell, a resilient member disposed in the air cell, and a check valve and a pressure regulating valve both communicated with the air cell, the resilient member having a punched section and an unpunched section, the pressure regulating valve having a pressure threshold.

As illustrated in FIG. 1, FIG. 2 and FIG. 6*a*, first a pressure regulation device is provided, which may be the third supporting part 30 of the aforesaid patient support structure 1, the third supporting part 30 comprising at least one pressure relief module 300, each pressure relief module 300 comprising an air cell 310, a resilient member disposed in the air cell 310 (corresponding to the third resilient member 320) and a check valve 330 and a pressure regulating valve 340 both communicated with the air cell 310; the resilient member has a punched section (corresponding to the first supporting area 321 of the third resilient member 320) and unpunched section (corresponding to the second supporting area 322 of the third resilient member 320), and the air cell 310 contains a certain amount of gas accommodated in the punched holes of the punched section. The pressure regulating valve 340 is set with a pressure threshold, such that the pressure regulating valve 340 is automatically opened when the pneumatic pressure reaches the pressure threshold.

Step S2: applying an external pressure to the pressure regulation device to deform the pressure regulation device such that the punched section and the unpunched section provide pressure support of different strengths, wherein if the external pressure causes a pneumatic pressure at the pressure regulation device of greater than the pressure threshold, the pressure regulating valve discharges air to adjust the pneumatic pressure.

As shown in FIG. 1, FIG. 2 and FIG. 6*a*, when a patient is lying on the patient support structure 1, an external pressure is formed on the supporting surface S of the patient support structure 1 such that the third supporting part 30 of the patient support structure 1 is deformed. As the third resilient member 320 in the pressure relief module 300 of the third supporting part 30 has a punched section (corresponding to the first supporting area 321) and an unpunched section (corresponding to the second supporting area 322), pressure support of different strengths may be provided to fit different levels of external pressure.

Figure 10A:
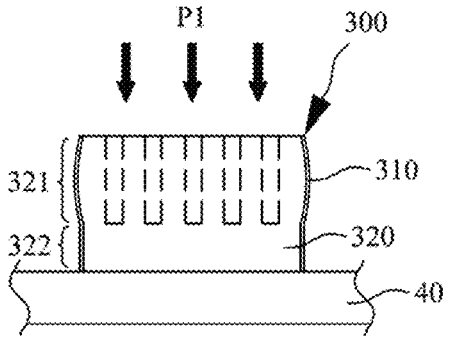
FIG. 10*a* to FIG. 10*c* illustrate the pressure relief module of the patient support structure according to the present disclosure under different external pressures.
Figure 10B:
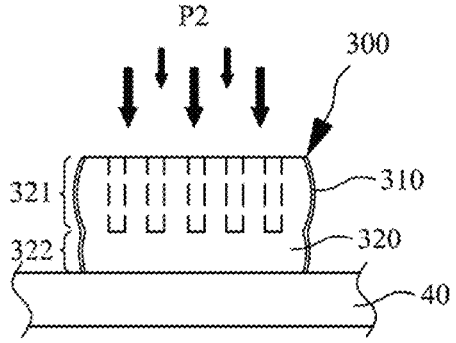
Figure 10C:
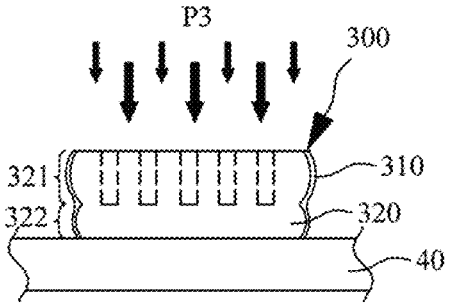

FIGS. 10*a* to 10*c* illustrate the pressure relief module 300 under different external pressures. As shown in FIG. 6*c* and FIG. 10*a*, the external pressure imposed by a patient with moderate body weight (e.g., less than 100 kg) lying on the pressure relief module 300 is designated as P1. When a patient is lying on the pressure relief module 300, the punched section of the third resilient member 320 (corresponding to the first supporting area 321) will be pressed and partially deformed and collapsed, but the pneumatic pressure in the air cell 310 and the structural intensity of the partially deformed punched section of the third resilient member 320 are sufficient to provide a proper support to the patient's body. With the aforesaid design and configuration, the contact pressure between patient's body and the supporting surface of the pressure relief module 300 may be maintained within a desirable range in most situations.

As shown in FIG. 6*c* and FIG. 10*b*, the external pressure imposed by a heavier patient (e.g., between 100 kg and 200 kg) lying on the pressure relief module 300 is designated as P2. When a heavier patient is lying on the pressure relief module 300, the punched section of the third resilient member 320 will be strongly pressed and substantially deformed and collapsed; meanwhile, since only the first supporting area 321 of the third resilient member 320 is provided with punched holes for receiving gas and therefore the amount of gas received in the air cell 310 is limited, the unpunched section (corresponding to the second supporting area 322) of the third resilient member 320 may provide a stronger support, such that even if the punched section of the third resilient member 320 has been substantially deformed and collapsed, the pneumatic pressure in the air cell 310 and the structural strength of the punched section and the unpunched section of the deformed third resilient member 320 may still provide sufficient support to the patient's body, not simply using the pneumatic pressure in the air cell to provide support. With the aforesaid design and configuration, the contact pressure between patient's body and the supporting surface of the pressure relief module 300 may also be maintained within a desirable range in most situations.

As shown in FIG. 6*b*, FIG. 6*c* and FIG. 10*c*, the external pressure imposed by an overweight patient (e.g., greater than 200 kg) lying on the pressure relief module 300 is designated as P3. When such patient is lying on the pressure relief module 300, both the punched section and the unpunched section of the third resilient member 320 are overly pressed and more strongly deformed and collapsed. In this situation, the structural strength of the punched section and the unpunched section of the third resilient member 320 fails to provide sufficient support, and the pneumatic pressure in the air cell 310 is greater than the pressure threshold of the pressure regulating valve 340; accordingly, the pressure regulating valve 340 will be switched on to discharge air in the air cell so as to adjust the pneumatic pressure of the pressure regulation device until the pneumatic pressure drops to a level of less than the pressure threshold. With the aforesaid design and configuration, the contact pressure between patient's body and the supporting surface of the pressure relief module 300 may still be maintained within a desirable range in most situations even if the contact pressure is increased due to a strong pneumatic pressure.

In addition, even if the punched section and the unpunched section of the third resilient member 320 are unable to provide sufficient support under the strong pressure, since the third resilient member 320 has an unpunched section configured as a solid structure, the unpunched section may still serve as a cushioning member during collapse and deformation to prevent the patient lying on the pressure relief module 300 in step S2 from being in direct contact with the bottom cushion 40.

In addition, the non-powered pressure regulation method may further comprises, after step S2, a step S3: when the external pressure is reduced or removed, the pressure regulation device recovering its original shape to introduce air from the check valve.

From step S2, as illustrated in FIG. 6*b*, FIG. 6*c* and FIG. 10*c*, when an external pressure P3 is applied to the pressure relief module 300, the pneumatic pressure in the air cell 310 is greater than the pressure threshold to drive the pressure regulating valve to discharge air, such that the pneumatic pressure in the air cell 310 becomes less than 1 atm. When the external pressure P3 is reduced or removed, the deformed third resilient member 320 gradually recovers its original shape and generates suction to introduce outside air from the check valve 330 into the air cell until the third resilient member 320 has completely recovered its original shape, and at the same time the pneumatic pressure in the air cell 310 is resumed to the original 1 atm. Accordingly, the non-powered pressure regulation method according to the present disclosure may achieve automatic pressure regulation for the pressure relief module 300 without any additional power devices such as inflation devices like pumps, which is more useful and convenient than conventional pressure relief apparatuses such as air mattresses which require inflation.

Figure 11:
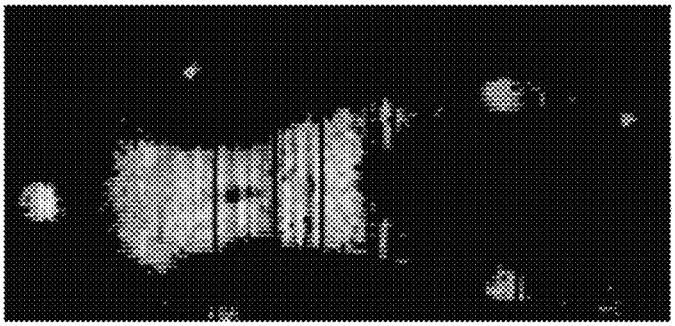
FIG. 11 to FIG. 13 illustrate the PRI profiles of various samples simulated under different body weight conditions.
Figure 11:
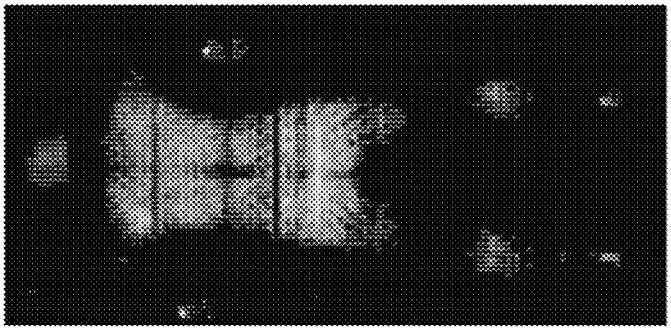
Figure 11:
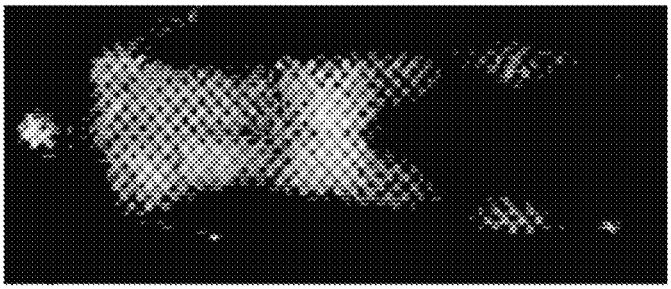
Figure 12:
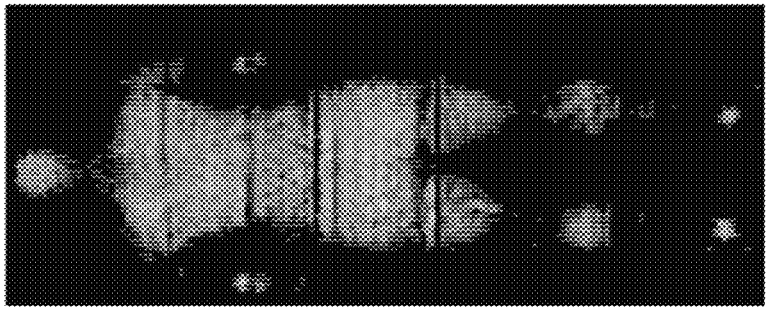
Figure 12:
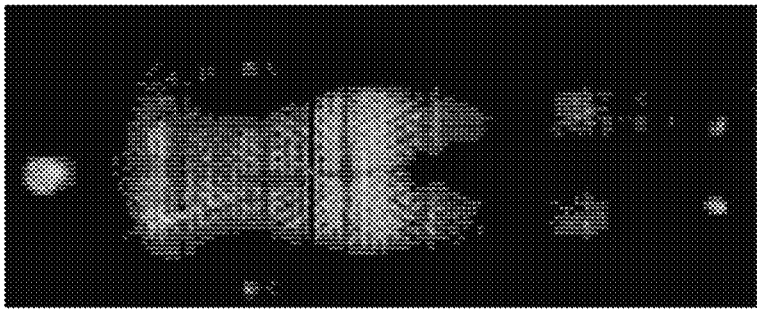
Figure 12:
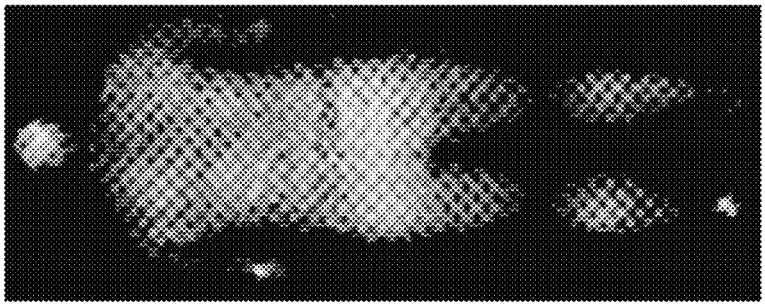
Figure 13:
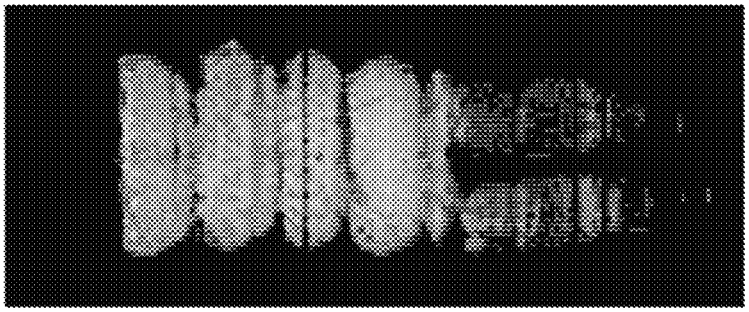
Figure 13:
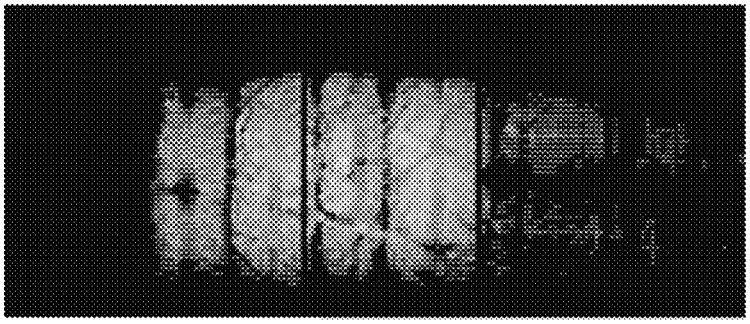
Figure 13:
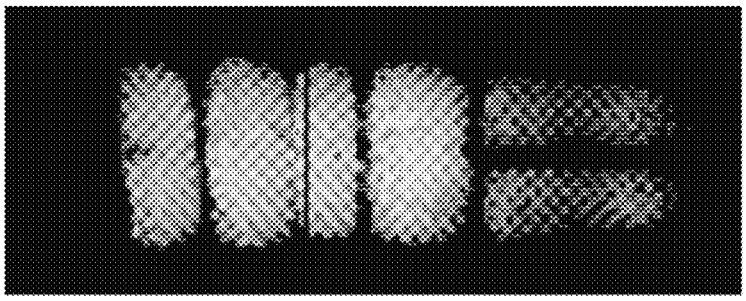

Refer to FIG. 11 to FIG. 13. FIG. 11 illustrates the PRI profile of various samples simulated under a patient's body weight of less than 100 kg; FIG. 12 illustrates the PRI profile of various samples simulated under a patient's body weight of 100 kg to 200 kg; and FIG. 13 illustrates the PRI profile of various samples simulated under a patient's body weight of greater than or equal to 180 kg. In the simulation of FIG. 11 to FIG. 13, the patient support structure 1 according to the present disclosure serves as the Example a, and conventional products commercially available from other suppliers serve as the Comparative Examples b and c. The Example a and the Comparative Examples b and c are subject to surface pressure tests with patients of different body weights so as to calculate the corresponding pressure relief index (PRI) and determine the efficacy of the patient support structure 1 according to the present disclosure. The Comparative Example b is a mattress structure configured as an assembly of an air cell and a resilient member to provide pressure relief and cushioning; the Comparative Example c is also a mattress structure completely covered with a solid foam material configured with a corrugated surface and provided with a plurality of air cells below the foam material corresponding to patient's torso. As used herein, pressure relief index represents the percentage of time a contact pressure between the supporting surface and patient's body is maintained within a pressure range; for example, in Table 1, the Example a has a pressure relief index of 32.12% corresponding to the pressure range of 8.7 to 16.5 mmHg, which means that in 32.12% of a period of time, the contact pressure between the supporting surface and patient's body ranges from 8.7 to 16.5 mmHg, and so on. The PRI profiles of various samples illustrated in FIG. 11 to FIG. 13 may derive a PRI distribution as shown in Table 1 to Table 3 below.

TABLE 1

(corresponding to FIG. 11)

| Pressure range/mmHg | Example a | Comparative Example b | Comparative Example c |
|---|---|---|---|
| 0-8.7 | 0 | 0 | 0 |
| 8.7-16.5 | 46.02% | 45.38% | 48.66% |
| 16.5-24.2 | 41.63% | 41.86% | 34.24% |
| 24.2-32.0 | 12.16% | 11.68% | 15.25% |

TABLE 1-continued (corresponding to FIG. 11)

| Pressure range/mmHg | Example a | Comparative Example b | Comparative Example c |
|---|---|---|---|
| 32.0-39.7 | 0.13% | 1.08% | 1.80% |
| 39.7-47.5 | 0.06% | 0 | 0.05% |
| 47.5-55.2 | 0 | 0 | 0 |
| 55.2-62.9 | 0 | 0 | 0 |
| 62.9-70.7 | 0 | 0 | 0 |
| 70.7-78.4 | 0 | 0 | 0 |

TABLE 2

(corresponding to FIG. 12)

| Pressure range/mmHg | Example a | Comparative Example b | Comparative Example c |
|---|---|---|---|
| 0-8.7 | 0 | 0 | 0 |
| 8.7-16.5 | 43.03% | 45.52% | 46.91% |
| 16.5-24.2 | 36.55% | 38.84% | 33.55% |
| 24.2-32.0 | 19.88% | 14.30% | 22.11% |
| 32.0-39.7 | 0.54% | 1.34% | 16.37% |
| 39.7-47.5 | 0 | 0.68% | 3.15% |
| 47.5-55.2 | 0 | 0 | 0.03% |
| 55.2-62.9 | 0 | 0 | 0 |
| 62.9-70.7 | 0 | 0 | 0 |
| 70.7-78.4 | 0 | 0 | 0 |

TABLE 3

(corresponding to FIG. 13)

| Pressure range/mmHg | Example a | Comparative Example b | Comparative Example c |
|---|---|---|---|
| 0-8.7 | 0 | 0 | 0 |
| 8.7-16.5 | 32.12% | 27.78% | 26.96% |
| 16.5-24.2 | 27.78% | 25.86% | 24.97% |
| 24.2-32.0 | 33.88% | 31.14% | 22.11% |
| 32.0-39.7 | 6.13% | 14.51% | 18.36% |
| 39.7-47.5 | 0.09% | 0.68% | 7.03% |
| 47.5-55.2 | 0 | 0 | 0.51% |
| 55.2-62.9 | 0 | 0.03% | 0.03% |
| 62.9-70.7 | 0 | 0 | 0 |
| 70.7-78.4 | 0 | 0 | 0.03% |

Data from FIG. 11 to FIG. 13 and Table 1 to Table 3 can be calculated by setting a pressure of 32 mmHg between the supporting surface and the body as the criterion for comparison to provide a PRI distribution as listed in Table 4.

TABLE 4

| Load | Sample | <32 mmHg | ≥32 mmHg |
|---|---|---|---|
| 200 kg/185 cm | Example a | 93.8% | 6.2% |
| | Comparative Example b | 84.8% | 15.2% |
| | Comparative Example c | 74.0% | 26.0% |
| 104 kg/180 cm | Example a | 99.5% | 0.5% |
| | Comparative Example b | 98.7% | 1.3% |
| | Comparative Example c | 96.8% | 3.2% |
| 73 kg/173 cm | Example a | 99.5% | 0.5% |
| | Comparative Example b | 98.9% | 1.1% |
| | Comparative Example c | 98.2% | 1.82% |

As shown in FIG. 11, Table 1 and Table 4, if the patient's body weight is less than 100 kg, the patient support structure 1 according to the present disclosure has a pressure relief index up to 99.5% for a pressure of less than 32 mmHg of the supporting surface S, which is greater than 99% and superior to 98.9% of the Comparative Example b and 98.2% of the Comparative Example c. As shown in FIG. 12, Table 2 and Table 4, if the patient's body weight is between 100 kg and 200 kg, the patient support structure 1 according to the present disclosure also has a pressure relief index up to 99.5% for a pressure of less than 32 mmHg of the supporting surface S, which is greater than 99% and superior to 98.7% of the Comparative Example b and 96.8% of the Comparative Example c. As shown in FIG. 13, Table 3 and Table 4, if the patient's body weight is greater than or equal to 180 kg, e.g., up to 200 kg, the patient support structure 1 according to the present disclosure has a pressure relief index up to 93.8% for a pressure of less than 32 mmHg of the supporting surface S, which is greater than 85% and significantly superior to 84.8% of the Comparative Example b and 74.0% of the Comparative Example c.

Therefore, the patient support structure 1 according to the present disclosure not only provides a better pressure relief index than other products for patients with moderate body weight or heavier patients, but also achieves excellent pressure relief index for overweight patients, such that the patient support structure 1 according to the present disclosure is widely applicable to patients of various different body weights, providing more comfortable lying support and preventing the development of pressure ulcers.

In the following embodiments, the patient support structure 1 according to the present disclosure serving as the Example a, a solid foam with a flat surface serving as the Comparative Example d, and the aforesaid Comparative Example c are subject to surface pressure simulation tests for a patient of 70 kg to 200 kg so as to measure the respective peak surface pressures to evaluate the efficacy of the first supporting part 10 of the patient support structure 1 according to the present disclosure. The results are listed in Table 5.

TABLE 5

| Sample | Peak/mmHg |
|---|---|
| Example a | 31.9 |
| Comparative Example d | 45.2 |
| Comparative Example c | 68.0 |

As can be observed from Table 5, the patient support structure 1 according to the present disclosure, in a section of the supporting surface S corresponding to the first supporting part 10, under a pressure corresponding to a body weight of 70 kg to 200 kg, has a peak surface pressure down to 31.9 mmHg, which is less than 40 mmHg and superior to 45.2 mmHg of the Comparative Example d and 68.0 mmHg of the Comparative Example c. In addition, the patient support structure 1 according to the present disclosure, in a section of the supporting surface S corresponding to the second supporting part 20, under a pressure corresponding to a body weight of 70 kg to 200 kg, has a peak surface pressure down to 36.2 mmHg, which is less than 37 mmHg.

Therefore, in the patient support structure 1 according to the present disclosure, the supporting surface S achieves a lower peak surface pressure than other products in all sections corresponding to the first supporting part 10 or the second supporting part 20, enabling the patient support structure 1 according to the present disclosure to effectively inhibit surface pressure and provide more comfortable lying support.

Moreover, the resilient member or foam used in the present disclosure may refer to a polyurethane foam having such as a sheet-like or block-like structure and passing the fireproof test BS 5852-2; 1992. For example, in some embodiments, the foam refers to the 3240 foam produced by the Tarn Chia Industries Co., Ltd., but the present disclosure is not limited thereto, and other foams may also be useful for the purpose of the present disclosure.

The above detailed description is merely illustrative in nature and is not intended to limit the embodiments of the subject matter or the application and uses of such embodiments. Moreover, while at least one exemplary example or comparative example has been presented in the foregoing detailed description, it should be appreciated that a vast number of variations exist. It should also be appreciated that the exemplary one or more embodiments described herein are not intended to limit the scope, applicability, or configuration of the claimed subject matter in any way. Rather, the foregoing detailed description will provide those skilled in the art with a convenient guide for implementing the described one or more embodiments. Also, various changes can be made in the function and arrangement of elements without departing from the scope defined by the claims, which include known equivalents and foreseeable equivalents at the time of filing this patent application.

What is claimed is:

1. A patient support structure, comprising:

a first supporting part comprising a first resilient member;

a second supporting part comprising a second resilient member; and a third supporting part between the first supporting part and the second supporting part;

wherein the first supporting part, the second supporting part and the third supporting part together define a supporting surface extending along a longitudinal axis, and wherein the second resilient member comprises a first supporting area and a second supporting area different in supporting strength;

wherein the first supporting area and the second supporting area of the second resilient member both comprise a plurality of through holes extending in the same direction; wherein the plurality of through holes of the first supporting area of the second resilient member collectively define a total volume greater than that of the plurality of through holes of the second supporting area of the second resilient member, and wherein the plurality of through holes of the first supporting area of the second resilient member are alternately arranged opposite to each other;

wherein the patient support structure is a hybrid pressure relief device, and wherein the third supporting part comprises a pneumatic pressure relief module comprising an air cell and a third resilient member disposed in the air cell;

wherein the third resilient member comprises a plurality of blind holes perpendicular to the supporting surface and forms a first supporting area and a second supporting area; wherein the first supporting area of the third resilient member is a punched section comprising the plurality of blind holes, and the second supporting area of the third resilient member is an unpunched section without the plurality of blind holes; and wherein the first supporting area of the third resilient member is 1.5 to 2.5 times thicker than the second supporting area of the third resilient member.

2. The patient support structure of claim 1, wherein the first supporting area of the second resilient member has a supporting strength less than that of the second supporting area of the second resilient member, and wherein the first supporting area of the second resilient member is arranged between the supporting surface and the second supporting area of the second resilient member.

3. The patient support structure of claim 1, wherein each of the plurality of alternately arranged opposite through holes of the first supporting area of the second resilient member has a substantially triangular cross section.

4. The patient support structure of claim 1, wherein the second resilient member comprises a plurality of foams arranged independently and extending in parallel to the longitudinal axis of the supporting surface.

5. The patient support structure of claim 1, wherein the third resilient member comprises a first foam and a second foam, and wherein the air cell secures relative positions of the first foam and the second foam by covering the third resilient member.

6. The patient support structure of claim 1, wherein:

under an external pressure corresponding to the body weight less than 100 kg weight, pressure relief index is greater than 99% of the time that the pressure between the supporting surface and the body being maintained less than 32 mmHg;

under an external pressure corresponding to the body weight between 100 kg and 200 kg, pressure relief index is greater than 99% of the time that the pressure between the supporting surface and the body being maintained less than 32 mmHg; or under an external pressure corresponding to the body weight greater than or equal to 180 kg, pressure relief index is greater than 85% of the time that the pressure between the supporting surface and the body being maintained less than 32 mmHg.

7. The patient support structure of claim 1, wherein the supporting surface, with the presence of a 70 kg to 200 kg body weight thereon, has a peak surface pressure of less than 37 mmHg at the second supporting part, and wherein the supporting surface, with the presence of a 70 kg to 200 kg body weight thereon, has a peak surface pressure of less than 40 mmHg at the first supporting part.

* * * * *